US012276268B2

(12) United States Patent
Toda

(10) Patent No.: US 12,276,268 B2
(45) Date of Patent: Apr. 15, 2025

(54) RECIPROCATING PUMP

(71) Applicant: TACMINA CORPORATION, Osaka (JP)

(72) Inventor: Naoya Toda, Hyogo (JP)

(73) Assignee: TACMINA CORPORATION, Osaka (JP)

( * ) Notice: Subject to any disclaimer, the term of this patent is extended or adjusted under 35 U.S.C. 154(b) by 414 days.

(21) Appl. No.: 17/636,448

(22) PCT Filed: Jul. 6, 2020

(86) PCT No.: PCT/JP2020/026412

§ 371 (c)(1),
(2) Date: Feb. 18, 2022

(87) PCT Pub. No.: WO2021/033440

PCT Pub. Date: Feb. 25, 2021

(65) Prior Publication Data

US 2022/0290661 A1 Sep. 15, 2022

(30) Foreign Application Priority Data

Aug. 22, 2019 (JP) ..... 2019-151970

(51) Int. Cl.
*F04B 19/22* (2006.01)
*F04B 1/141* (2020.01)
(Continued)

(52) U.S. Cl.
CPC ..... *F04B 19/22* (2013.01); *F04B 1/141* (2013.01); *F04B 23/06* (2013.01); *F04B 53/10* (2013.01);
(Continued)

(58) Field of Classification Search
CPC ..... F04B 19/22; F04B 1/141; F04B 23/06; F04B 43/02; F04B 43/025; F04B 53/10;
(Continued)

(56) References Cited

U.S. PATENT DOCUMENTS 2,785,638 A * 3/1957 Moller ..... F04B 43/02 251/129.09
9,158,308 B2 * 10/2015 Lohkamp ..... F04B 39/10
(Continued)

FOREIGN PATENT DOCUMENTS

CN 103277298 A 9/2013
CN 105986982 A 10/2016
(Continued)

*Primary Examiner* — David N Brandt
(74) *Attorney, Agent, or Firm* — The Webb Law Firm

(57) ABSTRACT

Provided is a reciprocating pump including: pump sections that are disposed in parallel with each other, each of the pump sections including a suction part for inflow of fluid, and a discharge part for outflow of fluid; a suction-side fluid passage for connection between the suction parts of the pump sections; and a discharge-side fluid passage for connection between the discharge parts of the pump sections; each of the pump sections includes a suction valve that allows and blocks circulation of fluid to be sucked, and a discharge valve that allows and blocks circulation of fluid to be discharged; a suction-valve operation member that opens the suction valve from outside; and a discharge-valve operation member that opens the discharge valve from outside. The suction-side fluid passage and the discharge-side fluid passage are expandable and contractible in a pipe axial direction.

4 Claims, 7 Drawing Sheets

(51) Int. Cl.

| | |
|---|---|
| ***F04B 7/00*** | (2006.01) |
| ***F04B 23/06*** | (2006.01) |
| ***F04B 43/02*** | (2006.01) |
| ***F04B 53/10*** | (2006.01) |
| ***F04B 53/16*** | (2006.01) |
| ***F04B 53/22*** | (2006.01) |

(52) U.S. Cl.
CPC ..... *F04B 7/0088* (2013.01); *F04B 43/026* (2013.01); *F04B 53/16* (2013.01); *F04B 53/22* (2013.01)

(58) Field of Classification Search
CPC ..... F04B 7/0088; F04B 43/026; F04B 53/16; F04B 53/22; F16L 23/08; F16L 23/10; F16L 27/12; F16L 27/127
See application file for complete search history.

(56) References Cited

U.S. PATENT DOCUMENTS

| | | | | |
|---|---|---|---|---|
| 2007/0261888 | A1* | 11/2007 | Urquhart | F04B 23/06 175/217 |
| 2017/0298919 | A1* | 10/2017 | West | F04B 53/08 |
| 2017/0306935 | A1 | 10/2017 | Fujiwara | |
| 2020/0277951 | A1* | 9/2020 | Hunter | F04B 17/05 |

FOREIGN PATENT DOCUMENTS

| | | | | |
|---|---|---|---|---|
| JP | S5770587 | U | 4/1982 | |
| JP | S61106983 | A | 5/1986 | |
| JP | 200757539 | A | 3/2007 | |
| JP | 201679837 | A | 5/2016 | |
| WO | WO-2013055304 | A1 * | 4/2013 | F16L 19/00 |
| WO | 2017153808 | A1 | 9/2017 | |

* cited by examiner

RECIPROCATING PUMP

CROSS-REFERENCE TO RELATED APPLICATIONS

This application is the United States national phase of International Application No. PCT/JP2020/026412 filed Jul. 6, 2020, and claims priority to Japanese Patent Application No. 2019-151970 filed Aug. 22, 2019, the disclosures of which are hereby incorporated by reference in their entirety.

BACKGROUND OF THE INVENTION

Field of the Invention

The present invention relates to a reciprocating pump that is configured to feed fluid by reciprocal motions of a reciprocating member which causes change in volume of a pump chamber.

Description of Related Art

JP2016-79837A discloses an example of the reciprocating pump. The reciprocating pump (diaphragm pump) disclosed in this literature includes two pump chambers located on the right and left sides in parallel with each other as viewed from the front side. A suction part for inflow of fluid (liquid) into a pump chamber and a discharge part for outflow of fluid from a pump chamber are connected to each of the right and left pump chambers. Each of the suction part and the discharge part has a single flow passage.

CITATION LIST

Patent Literature

Patent Literature 1: JP 2016-79837 A

SUMMARY OF THE INVENTION

Technical Problem

In maintenance of a pump having a relatively small capacity, it was possible to deal with removal of the liquid remaining in a pump chamber by receiving the liquid with a bucket or the like (i.e., residue disposal). There is a need for a pump having a large capacity. In a large capacity pump that meets this need, the residue remaining in the pump chamber is larger than that of the small capacity pump in the maintenance operation, and therefore it is difficult to receive the residue with a bucket or the like unlike the conventional treatment. Thus, a special care must be taken for such residue disposal.

Further, in the maintenance operation such as pump chamber disassembly maintenance, there is a case where the maintenance is demanded for not all but one or some of pump chambers (e.g., only one pump chamber). However, suction parts and discharge parts described in the above literature are fixedly connected to a plurality of (specifically two) pump chambers. Thus, fluid flowing into and flowing out of the plurality of pump chambers is configured to flow while converging into the suction parts and the discharge parts. Therefore, even in the case where the maintenance is performed only for one or some of the pump chambers, all the suction parts and the discharge parts were required to be dismounted. Thus, there was a room for improvement in maintainability of the pump section that is a section including the pump chambers.

In view of the above, it is an object of the present invention to provide a reciprocating pump that allows for easy residue disposal when the maintenance is performed, and easy maintenance for one or some of a plurality of pump chambers.

Solution to Problem

The present invention is a reciprocating pump including: a plurality of pump sections that are disposed in parallel with each other, each of the plurality of pump sections including a suction part for inflow of fluid, and a discharge part for outflow of fluid; a suction-side fluid passage for connection between the suction parts of the plurality of pump sections; and a discharge-side fluid passage for connection between the discharge parts of the plurality of pump sections; each of the plurality of pump sections including: a suction valve that allows and blocks circulation of fluid to be sucked, and a discharge valve that allows and blocks circulation of fluid to be discharged; a suction-valve operation member that is configured to open the suction valve from outside; and a discharge-valve operation member that is configured to open the discharge valve from outside, wherein the suction-side fluid passage and the discharge-side fluid passage are expandable and contractible in the pipe axial direction.

It can be configures such that the suction-side fluid passage or the discharge-side fluid passage includes between adjacent ones of the suction parts or the discharge parts of the plurality of pump sections: a first pipe that is located on one side in the pipe axial direction; a second pipe that is located on the other side in the pipe axial direction; and a stopper that is disposed over between the first pipe and the second pipe to fix the first pipe and the second pipe to each other immovably in the pipe axial direction; the first pipe and the second pipe are partially overlapped with each other in the pipe axial direction; in the overlapped portion, the second pipe has an outer diameter smaller than an inner diameter of the first pipe so that the first pipe and the second pipe are slidable relative to each other in the pipe axial direction; the stopper includes: a fixing piece that is located adjacent to an end of the first pipe in the pipe axial direction and on a radially outer side of the second pipe; a sealing part that is held by the end of the first pipe, an outer surface of the second pipe, and the fixing piece to prevent leakage of fluid outside of the pipes; and a fastening device that is located on a radially outer side of the end of the first pipe and the fixing piece and configured to reduce a gap caused between the end of the first pipe and the fixing piece.

It can be configured such that a line connecting the suction-valve operation member, the discharge-valve operation member, the suction valve, and the discharge valve to each other crosses a line along the pipe axial direction of the suction-side fluid passage and the discharge-side fluid passage.

DESCRIPTION OF THE INVENTION

Hereinafter, the present invention will be described by taking one embodiment with reference to the accompanying drawings. A vertical direction and a right left direction herein described correspond to the directions shown in FIG. 1. Regarding the forward and backward direction, the side in the forward direction is referred to as the front side and the side in the aft direction is referred to as the back side.

Figure 1:
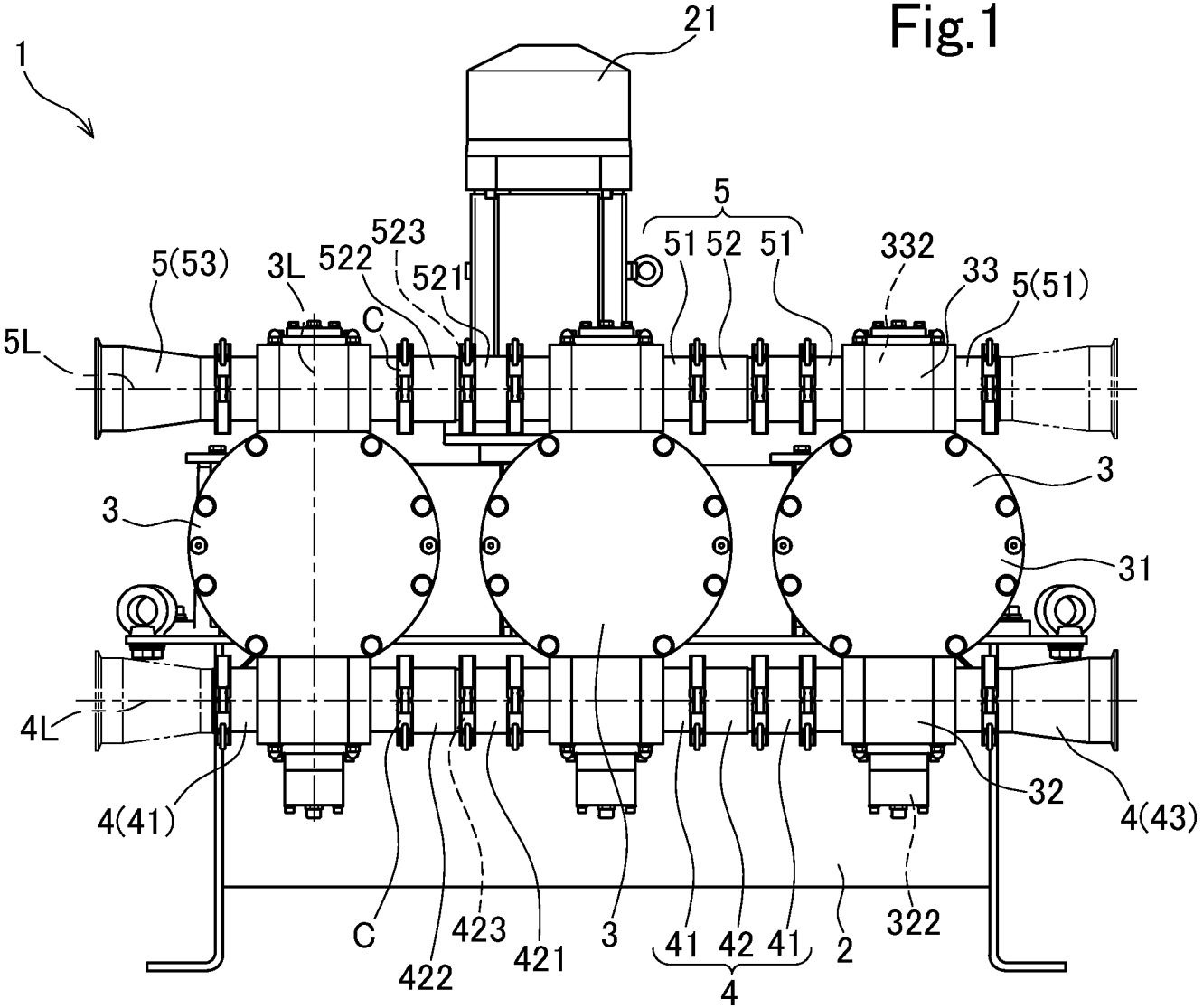
FIG. 1 is a front view showing a reciprocating pump according to an embodiment of the present invention.
Figure 2:
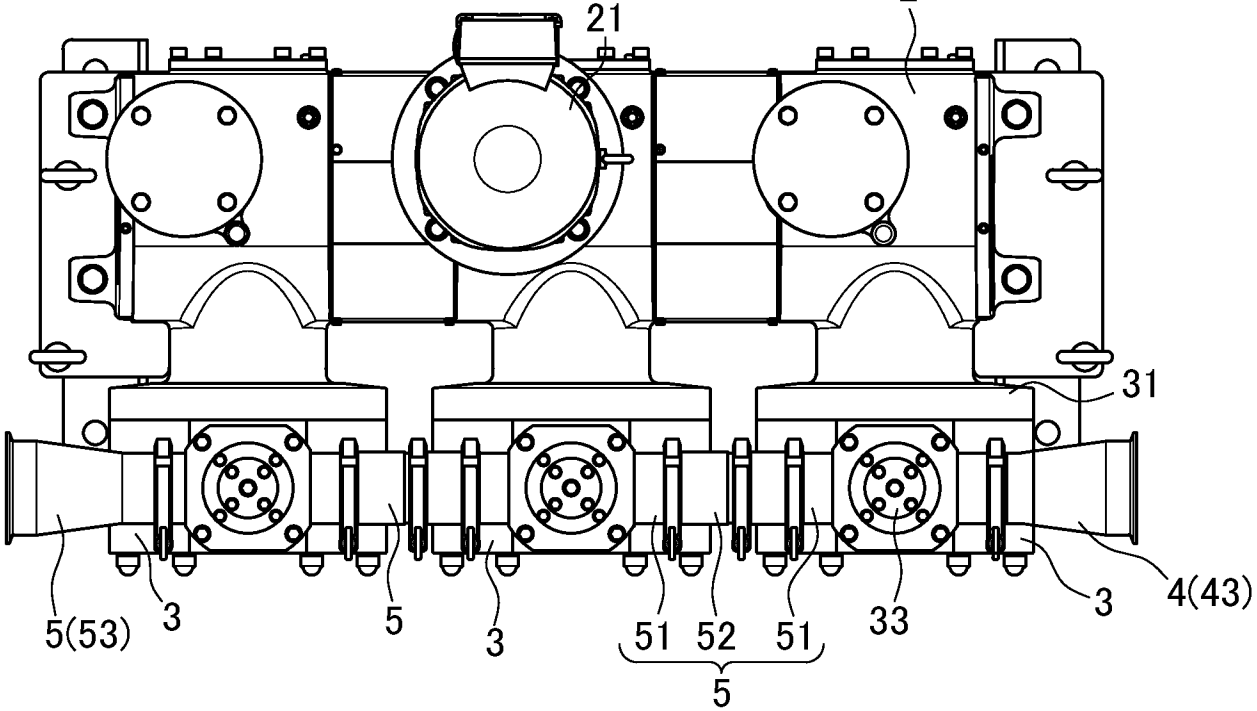
FIG. 2 is a plan view showing the reciprocating pump.

A reciprocating pump 1 (hereinafter referred to as the pump) of this embodiment is a diaphragm pump. Fluid to be treated by the pump 1 of this embodiment is liquid. As shown in FIG. 1 and FIG. 2, the pump 1 includes a main body 2 for generating and transmitting a driving force, and a pump section 3 (referred also to as the "pump head") that is located on the front side (forward side) and configured to feed the liquid. A suction-side fluid passage 4 and a discharge-side fluid passage 5 are connected to the pump section 3. In this embodiment, a plurality of pump sections 3 (three in this embodiment) are disposed in parallel with each other on the front side of a single main body 2.

The main body 2 includes a motor 21 as a driving source. A non-illustrated transmission mechanism inside the main body divides the driving force of the motor 21 and transmits it to a plurality of systems (three systems in this embodiment) while shifting the transmission and performing the timing adjustment. This driving force causes a plurality of pump shafts 22 located on the front side of the main body 2 to reciprocate back and force. The reciprocating timings of the plurality of pump shafts are shifted from each other in order to achieve uniform pulsation of the liquid fed by the pump sections 3.

Figure 3:
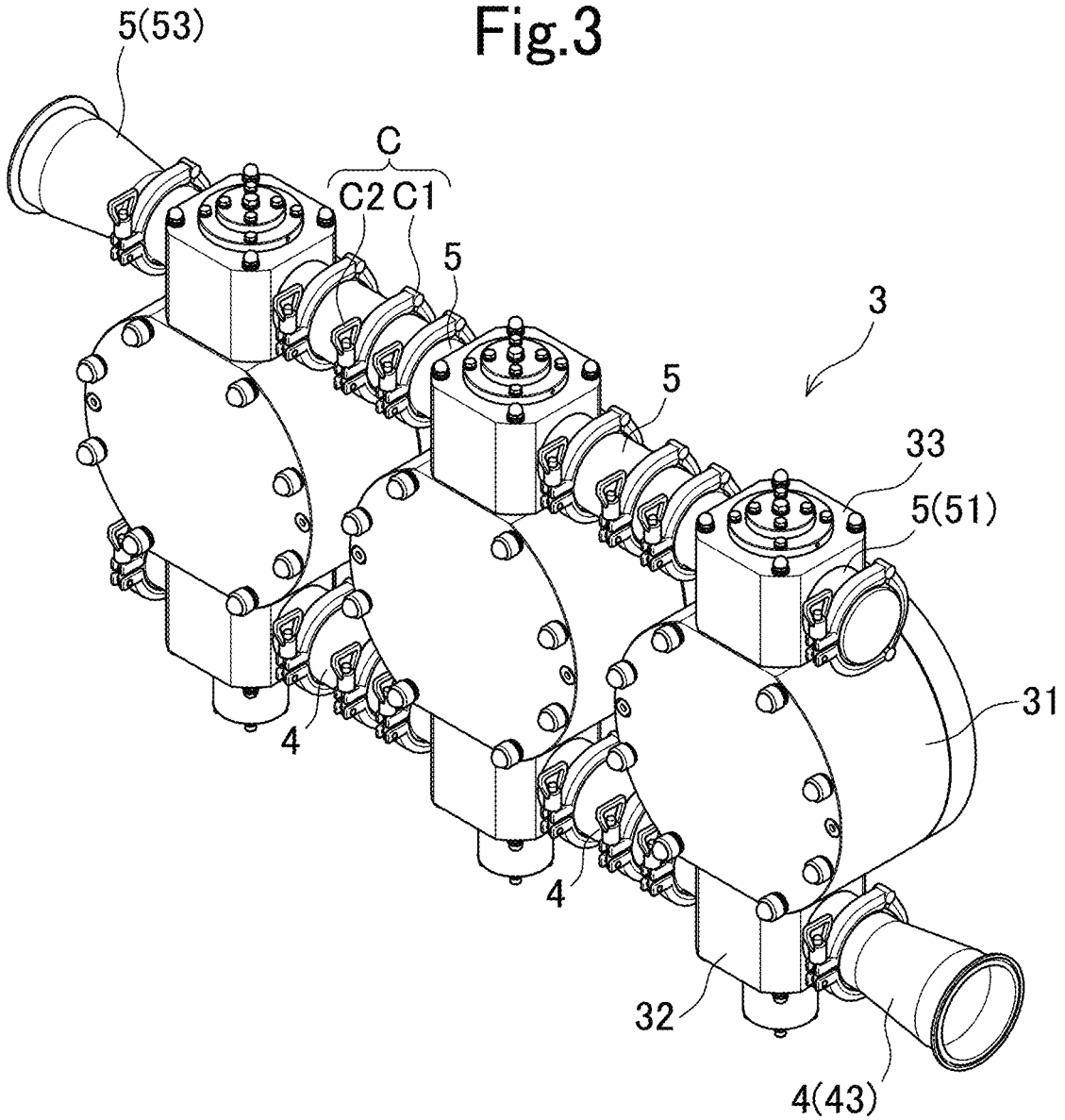
FIG. 3 is a front and top perspective view showing a pump section of the reciprocating pump.
Figure 4:
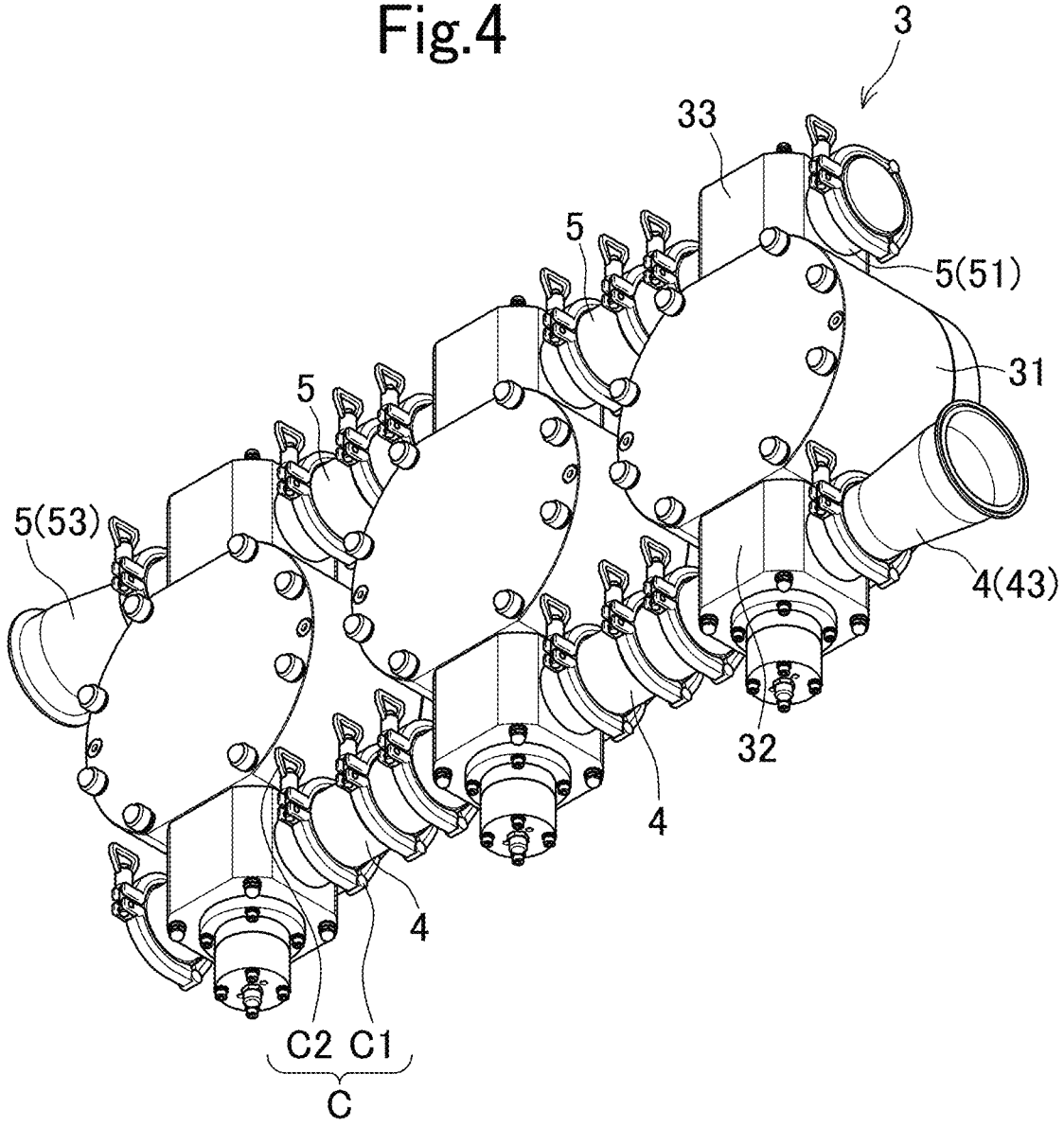
FIG. 4 is a front and bottom perspective view showing the pump section.
Figure 5:
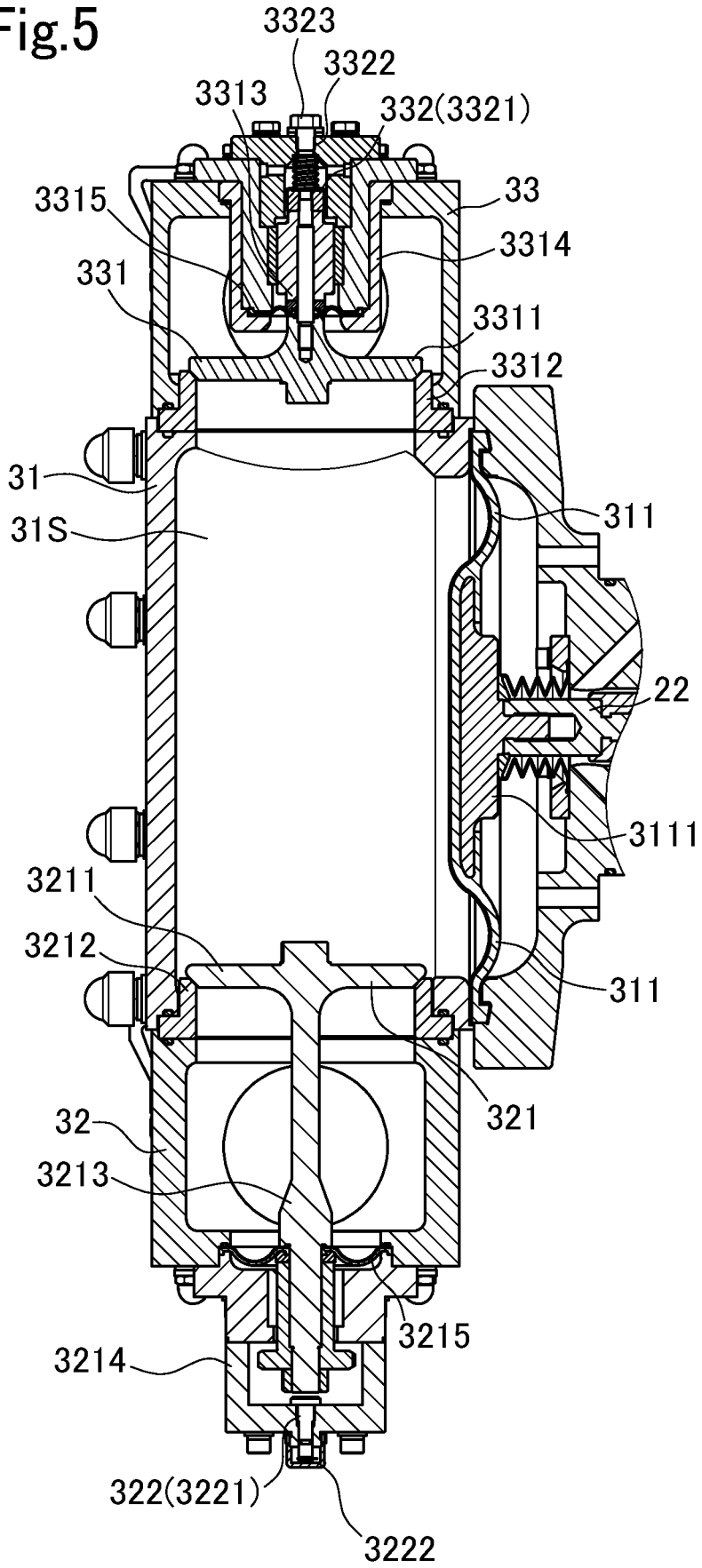
FIG. 5 is a vertical cross section of the pump section.

As shown in FIG. 3 to FIG. 5, each of the plurality of pump sections 3 includes a pump chamber 31 for fluid feeding, a suction part 32 for inflow of fluid into the pump chamber 31, and a discharge part 33 for outflow of fluid from the pump chamber 31.

A diaphragm 311 that is formed of a deformable material such as a soft resin and has a substantially plate shape such as a circular disc shape is disposed inside the pump chamber 31. An outer peripheral part of the diaphragm 311 is fluid-tightly pinched between a front wall of the main body 2 and a back wall of the pump chamber 31. The diaphragm 311 is connected to the pump shaft 22 of the main body 2, and a connection part 3111 that is connected to the pump shaft 22 (that is located at a center in the radial direction when the diaphragm 311 has a circular disc shape) moves in the thickness direction of the diaphragm 311, that is, moves back and forth, in association with the reciprocal motion of the pump shaft 22. When the diaphragm 311 has moved backward, the volume of an internal space 31S in the pump chamber 31 is increased so that the fluid flows into the pump chamber 31 from the suction part 32. On the other hand, when the diaphragm 311 has moved forward, the volume of the internal space 31S in the pump chamber 31 is reduced so that the fluid flows out of the pump chamber 31 toward the discharge part 33.

The suction part 32 includes a suction valve 321 that allows and blocks circulation of the fluid that flows toward the pump chamber 31 and is sucked thereinto. The suction-side fluid passage 4 is connected to each of the right side and the left side of the suction part 32. The suction-side fluid passage 4 is a pipe provided in each of the plurality of pump sections 3 to provide connection between adjacent ones of the suction parts 32. As shown in FIG. 1, the fluid which flows into the pump 1 through an external pipe (not shown) for supply of the fluid into the pump 1 enters the suction-side fluid passage 4 from an end pipe 43, and flows from the right side toward the left side in the suction-side fluid passage 4. A fixed pipe 41 that projects further from the suction part 32 of the left pump section 3 toward the left side has an end closed by an end plate attached thereto. As shown by the dashed-two dotted line in FIG. 1, the direction in which the fluid flows through the suction-side fluid passage 4 can be reversed so that the fluid flows from the left side toward the right side. In this case, the end pipe 43 and the closed end of the fixed pipe 41 are respectively located at the reverse positions.

The discharge part 33 includes a discharge valve 331 that allows and blocks circulation of the fluid that flows out of the pump chamber 31. The discharge-side fluid passage 5 is connected to each of the right side and the left side of the discharge part 33. The discharge-side fluid passage 5 is a pipe provided in each of the plurality of pump sections 3 to provide connection between adjacent ones of the discharge parts 33. As shown in FIG. 1, the fluid flows from the right side toward the left side in the discharge-side fluid passage 5 and then flows out into an external pipe (not shown) that is connected to the pump 1 through an end pipe 53. A fixed pipe 51 that projects further from the discharge part 33 of the right pump section 3 toward the right side has an end closed by an end plate attached thereto. As shown by the dashed-two dotted line in FIG. 1, the direction in which the fluid flows through the discharge-side fluid passage 5 can be reversed so that the fluid flows from the left side toward the right side. In this case, the end pipe 53 and the closed end of the fixed pipe 51 are respectively located at the reverse positions.

As shown in FIG. 5, a disk valve is used for each of the suction valve 321 and the discharge valve 331. The disk valve has a disk-shaped valve body 3211, 3311. An outer peripheral edge (i.e., tapered portions as shown in FIG. 5) of the valve body 3211, 3311 comes into contact with an annular valve seat 3212, 3312 provided in the suction part 32 and the discharge part 33 to thereby close the flow passages of the suction valve 321 and the discharge valve 331 and hence block the circulation of the fluid. The suction valve 321 is constantly biased in the direction opposite to the pump chamber 31 (downwardly biased). The discharge valve 331 is constantly biased in the direction toward the pump chamber 31 (downwardly biased). When a force of the fluid pushing the valve body 3211, 3311 exceeds the biasing force applied to the valve body 3211, 3311, the valve body 3211, 3311 separates away from the valve seat 3212, 3312 so that the fluid passages of the suction valve 321 and the discharge valve 331 are opened. Thus, the circulations of the fluid in the suction valve 321 and the discharge valve 331 are allowed.

A valve rod 3213, 3313 that has a straight rod shape and extends toward the opposite side to the pump chamber 31 is connected to the valve body 3211, 3311. The valve rod 3213, 3313 is partially surrounded by a partition member 3214, 3314 that is a bottomed cylindrical body. The valve rod 3213, 3313 extends through an end portion of the partition member 3214, 3314, and the extended portion is provided with a seal member 3215, 3315 to be fluid-tightly sealed in the axial direction of the valve rod 3213, 3313. A diaphragm having a substantially circular disc shape is used for the seal member 3215, 3315 of this embodiment. An outer peripheral part of the diaphragm is fixed to the partition member 3214, 3314, and a central part of the diaphragm moves in the vertical direction following the valve rod 3213, 3313. The valve rod 3213, 3313 reciprocates in the axial direction (i.e., the vertical direction) by the opening and closing motions of the valve body 3211, 3311. With this configuration, a sliding portion of the outer peripheral part of the valve rod 3213, 3313 relative to the partition member 3214, 3314 can be isolated from the fluid to be handled by the pump 1. Because of this, even in a case where fine particles are entrained in the fluid, it is possible to prevent the valve rod 3213, 3313 from being excessively worn by those fine particles, as compared with, for example, a poppet valve. Also, when the suction valve 321 and the discharge valve 331 are opened from the outside by operation members 322, 332, it is possible to prevent leakage of the fluid from any portion of the operation members 322, 332. It is also possible to reduce portions of the suction valve 321 and the discharge valve 331 that are in contact with the fluid. Thus, it is possible to reduce the influence applied to the fluid passing through the suction valve 321 and the discharge valve 331.

The suction part 32 includes a suction-valve operation member 322 that can open the suction valve 321 located inside the suction part 32 from the outside. The discharge part 33 includes a discharge-valve operation member 332 that can open the discharge valve 331 located inside the discharge part 33 from the outside.

The suction-valve operation member 322 is a pin 3221 having a short rod shape that can press the lower end of the valve rod 3213 upward. The pin 3221 is located on a downward extension line of the valve rod 3213. The pin 3221 is a separate body from the valve rod 3213. A part of the pin 3221 is exposed from the lower end surface of the suction part 32. This exposed part of the pin 3221 is usually covered by a cover 3222, and the cover 3222 is removed when the pin 3221 is used. The pin 3221 is pressed in from the outside of the suction part 32 to be brought into contact with the valve rod 3213, which causes the valve body 3211 to move upward and hence enable opening of the suction valve 321. Thereby, the fluid remaining in the pump chamber 31 (residue) is allowed to fall into the suction part 32 and thereby can be drained out into the suction-side fluid passage 4 through the suction part 32.

The discharge-valve operation member 332 is an engaging member 3321 that can pull an upper end of the valve rod 3313 upward. The engaging member 3321 is formed at the upper end of the valve rod 3313 to be located inside the discharge part 33. A through hole 3322 is formed at a position away from the engaging member 3321 on an upper side of the engaging member 3321 in the discharge part 33. The engaging member 3321 and the through hole 3322 are located on an upward extension line of the valve rod 3313. A pull-up rod (not shown) that is a separate body from the discharge part 33 is inserted into the through hole 3322. The pull-up rod has a lower end configured to be engageable with the engaging member 3321. For example, when the engaging member 3321 is a threaded hole formed at the upper end of the valve rod 3313, a threaded portion that can be brought into threaded engagement with the threaded hole is formed at the lower end of the pull-up rod. When the pull-up rod is moved upward while being engaged with the valve rod 3313, the valve body 3311 of the discharge valve 331 is moved downward so that the discharge valve 331 can be opened. Thereby, the residue remaining in the upper part of the discharge valve 331 can be transferred into the pump chamber 31. Then, the fluid passage of the fluid in the suction part 32 is opened as described above so that the residue can be drained into the suction-side fluid passage 4 through the suction part 32. Or, part of the residue remaining in the pump chamber 31 can be drained out into the discharge-side fluid passage 5 directly from the discharge part 33.

The through hole 3322 that is provided in the discharge part 33 to receive the pull-up rod is a threaded hole in this embodiment and is generally closed by a bolt 3323 attached thereto. The bolt 3323 is removed when the pull-up rod is inserted, and the through hole 3322 is exposed. A device for closing the through hole 3322 is not limited to the bolt 3323, and can be changed by various devices.

An operator operates the operation members 322, 332 from the outside in the manner mentioned above to open the suction valve 321 and the discharge valve 331 to cause most of the residue to move to the outside the pump 1 through the suction-side fluid passage 4 or the discharge-side fluid passage 5. Thus, it is possible to suppress the event that a large amount of the residue accidentally falls down from the pump 1, even when the pump section 3 is removed from the main body 2 or the pump chamber 31 is disassembled at the time of the maintenance. Therefore, for example, a surrounding area of the pump 1 is unlikely to be contaminated.

A line 3L (virtual line) connecting the operation members 322, 332 with the suction valve 321 and the discharge valve 331 crosses lines 4L, 5L (virtual lines) along a pipe axial direction of the suction-side fluid passage 4 and the discharge-side fluid passage 5. In this embodiment, the line 3L connecting the operation members 322, 332 with the suction valve 321 and the discharge valve 331 is a vertical line, and the lines 4L, 5L along the pipe axial direction of the suction-side fluid passage 4 and the discharge-side fluid passage 5 are horizontal lines (lateral lines) so that the lines 4L, 5L are orthogonal to the line 3L. The positional relationship between the lines 3L, 4L, and 5L remains unchanged in the forward and backward direction. With this positional relationship, the operator operates the operation members 322, 332 from the site away from the lines 4L, 5L along the pipe axial direction of the suction-side fluid passage 4 and the discharge-side fluid passage 5. Thus, the operator's hand is unlikely to interfere with the suction-side fluid passage 4 and the discharge-side fluid passage 5, which contributes to good workability of the operation members 322, 332.

Among the suction-side fluid passages 4 and the discharge-side fluid passages 5, a suction-side fluid passage 4 and a discharge-side fluid passage 5 held especially between the two pump sections 3 aligned in parallel with each other and located between the adjacent ones of the suction parts 32 or the adjacent ones of the discharge parts 33 are configured to be expandable and contractible in the pipe axial direction.

Each fluid passage 4, 5 includes a pipe 41, 51 that is fixedly provided to the suction part 32 or the discharge part 33, and an expansion pipe 42, 52 that is disposed between two fixed pipes 41, 51 aligned in the axial direction. In this embodiment, the fixed pipe 41, 51 and the expansion pipe 42, 52 are connected to each other by a ferrule F that is a flange part provided at an end of each of the pipes, and a fastening device C for fastening adjacent ones of the ferrules F of the pipes (although no illustration is made for the suction-side fluid passage 4, illustration is made for the discharge-side fluid passage 5 in FIG. 6). The ferrule F has a perpendicular surface relative to the pipe axial direction on the pipe end side, and a portion with a tapered surface on the opposite side to the end of the pipe in the pipe axial direction, which portion has a thickness larger on the radially inner side than on the radially outer side. A ferrule F provided at each of a later-described first pipe 421, 521 and a later-described fixing piece 5231 has the same shape as the ferrules F for these pipes (see FIG. 7). The connection between the fixed pipe 41, 51 and the expansion pipe 42, 52 is not limited to the connection using the ferrule F, and the flange connection or the screw connection can be employed.

The expansion pipe 42, 52 has a first pipe 421, 521 that is located on one side of the pipe axial direction (right side in this embodiment), a second pipe 422, 522 that is located on the opposite side in the pipe axial direction (left side in this embodiment), and a stopper 423, 523 that is disposed over between the first pipe 421, 521 and the second pipe 422, 522.

The first pipe 421, 521 and the second pipe 422, 522 are partially overlapped with each other in the pipe axial direction. In the overlapped portion, the second pipe 422, 522 has an outer diameter smaller than the inner diameter of the first pipe 421, 521. That is, in the overlapped portion, an outer periphery of the second pipe 422, 522 is covered with the first pipe 421, 521, and the second pipe 422, 522 fits into the first pipe 421, 521. This configuration allows the first pipe 421, 521 and the second pipe 422, 522 to slide relative to each other in the pipe axial direction. Therefore, the expansion pipe 42, 52 is expandable and contractible in the pipe axial direction according to the overlapped amount in the overlapped portion of the first pipe 421, 521 and the second pipe 422, 522.

Figure 7:
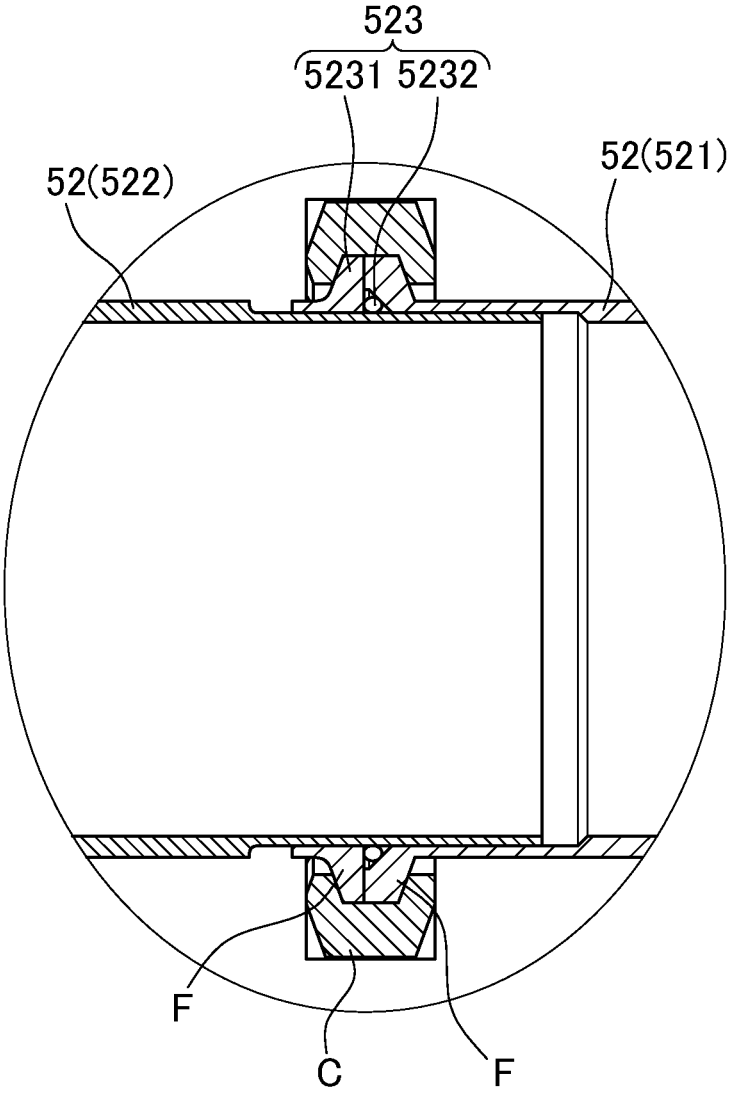
FIG. 7 is a main part enlarged view showing a stopper of the reciprocating pump.

The stopper 423, 523 is used to fix the first pipe 421, 521 and the second pipe 422, 522 to each other immovably in the pipe axial direction in the expansion pipe 42, 52 so that the expansion pipe 42, 52 does not expand and contract. As shown in FIG. 7, the stopper 523 includes a fixing piece 5231, a sealing part 5232, and a fastening device C. Note that since a fixing piece and a sealing part of the suction-side fluid passage 4 are not illustrated, no reference numbers are allocated thereto, and these members have the same shapes as those of the fixing piece 5231 and the sealing part 5232 in the suction-side fluid passage 4. The end of the first pipe 421, 521 is provided with a ferrule F that is a flange part. In a configuration to fix the first pipe 421, 521 and the second pipe 422, 522 to each other immovably in the pipe axial direction, the formation of the ferrule at the end of the first pipe 421, 521 is not essential. For example, in a case where the fastening device C is configured to allow the first pipe 421, 521 and the second pipe 422, 522 to be fixed to each other by threaded engagement, a threaded portion are formed in place of the ferrule F at the end of the first pipe 421, 521. The ferrule F of the first pipe 421, 521 has a radially inner peripheral edge having a tapered shape extending along the circumferential direction, and a later-described sealing part (specifically, O-ring with a reference number "5232" in the stopper 523).

The fixing piece of the suction-side fluid passage 4 and the fixing piece 5231 of the discharge-side fluid passage 5 are located adjacent to the ends of the first pipes 421, 521 in the pipe axial direction, and on the radially outer side of the second pipes 422, 522. The fixing pieces have a ring shape, more specifically a ring shape having an integral body in the circumferential direction, and have the same shape as that of the first pipe 421, 521. The fixing piece is disposed on the outer side of the second pipe 422, 522 to be movable in the pipe axial direction. The ferrule F that is a flange part is provided at the end on the side of the first pipe 421, 521. In a configuration to fix the first pipe 421, 521 and the second pipe 422, 522 to each other immovably in the pipe axial direction, the formation of the ferrule at each of the fixing pieces is not essential.

The sealing part of the suction-side fluid passage 4 and the sealing part 5232 of the discharge-side fluid passage 5 are held respectively between the ends of the first pipes 421, 521 (specifically, the tapered surfaces of the ferrules F), the outer surfaces of the second pipes 422, 522, and the fixing pieces 5231 (specifically, the perpendicular surfaces of the ferrules F). O-rings are used for these sealing parts of this embodiment. The ferrule F of the first pipe 421, 521 is brought into tight contact with the ferrule F of the fixing piece by the fastening device C so that a gap between the inner surface of the first pipe 421, 521 and the outer surface of the second pipe 422, 522 in the overlapped portion is closed by the sealing part. Thereby, the fluid leakage from the expansion pipe 42, 52 to the outside is prevented.

The fastening device C is disposed on the radially outer side of the end of the first pipe 421, 521 (specifically, ferrule F) and the fixing piece (specifically, ferrule F). The fastening device C has a ring shape. The fastening device C has a circumferential groove on an inner surface side (see FIG. 6 and FIG. 7). This groove has an inner surface shape corresponding to the tapered surface of the ferrule F. As shown in FIG. 3 and FIG. 4, the fastening device C has a hinge C1 around which the fastening device C is bendable toward the radially outer side. The fastening device C has another part in the circumferential direction at which the fastening device C is discontinuous. This discontinued part has opposite sides in the circumferential direction between which a screw C2 is provided so that a gap of the discontinued part can be reduced by fastening the screw C2. The screw C2 thus fastened can generate a compression force in the radially inward direction. This compression force enables the opposite two ferrules F to be brought into tight contact with each other. That is, a gap caused between the end of the first pipe 421, 521 and the fixing piece 5231 can be reduced. This fastening device C is the same as that for the connection part between the fixed pipe 41, 51 and the expansion pipe 42, 52. The fastening device C is used to fix the end plate for closing the end of each of the end pipe 43, 53 and the fixed pipe 41, 51 in the suction-side fluid passage 4 and the discharge-side fluid passage 5.

Figure 6:
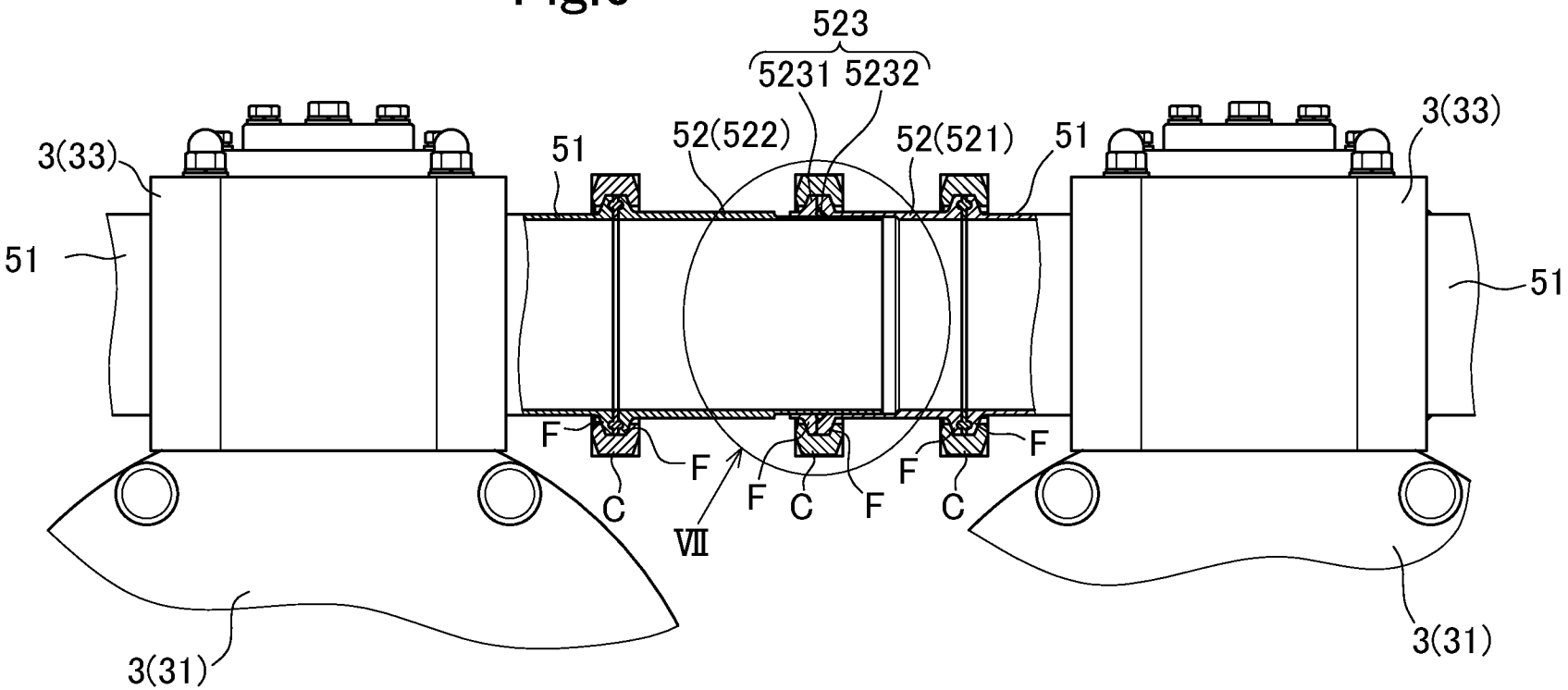
FIG. 6 is a cross section showing a discharge-side flow passage of the reciprocating pump.

As described for the discharge-side fluid passage 5 with reference to FIG. 6, the first pipe 421, 521 and the second pipe 422, 522 are partially overlapped with each other in the pipe axial direction in the expansion pipe 42, 52 so that the first pipe 421, 521 and the second pipe 422, 522 are slidable relative to each other in the pipe axial direction. The stopper 423, 523 for fixing the first pipe 421, 521 and the second pipe 422, 522 to each other is formed by the fixing piece 5231, the sealing part 5232, and the fastening device C. Therefore, a simplified configuration for expanding and contracting the suction-side fluid passage 4 and the discharge-side fluid passage 5 in the pipe axial direction can be achieved.

According to the thus configured expansion pipe 42, 52, when the operator loosens the fastening device C by rotating the screw C2 in a loosening direction for the maintenance of the pump 1, the first pipe 421, 521 and the second pipe 422, 522 can be slidably moved to each other. Thereby, the suction-side fluid passage 4 and the discharge-side fluid passage 5 are expanded and contracted in the pipe axial direction. Accordingly, when the suction-side fluid passage 4 and the discharge-side fluid passage 5 are shortened, one of the two adjacent pump sections 3 can be separated from the other one. Therefore, separate maintenance can be performed by separating one or some of the plurality of pump sections 3 from the remaining pump section 3 or pump sections 3.

According to the configuration that the expansion pipe 42, 52 is located between the adjacent suction parts 32 or discharge parts 33, the suction-side fluid passage 4 and the discharge-side fluid passage 5 can be manufactured without having to control dimensional tolerance for manufacturing with high precision as compared with a conventional immovable pipe. Thus, the suction-side fluid passage 4 and the discharge-side fluid passage 5 can be easily manufactured.

Although the present invention was described by taking, for example, one embodiment, the present invention is not limited to the embodiment and can be subjected to various modifications within the gist of the present invention.

For example, a valve used for the suction valve 321 and the discharge valve 331 is not limited to a disk valve of the above embodiment, and can be a valve having another configuration such as a ball valve. The operation member 322, 332 can be formed to have a configuration corresponding to the configuration of the valve.

The configuration and the operational effect on the above embodiment will be summarized below. This embodiment is a reciprocating pump including: a plurality of pump sections that are disposed in parallel with each other, each of the plurality of pump sections 3 including a suction part 32 for inflow of fluid, and a discharge part 33 for outflow of fluid; a suction-side fluid passage 4 for connection between the suction parts 32 of the plurality of pump sections 3; and a discharge-side fluid passage 5 for connection between the discharge parts 33 of the plurality of pump sections 3; each of the plurality of pump sections 3 including: a suction valve 321 that allows and blocks circulation of fluid to be sucked, and a discharge valve 331 that allows and blocks circulation of fluid to be discharged; a suction-valve operation member 322 that is configured to open the suction valve 321 from outside; and a discharge-valve operation member 332 that is configured to open the discharge valve 331 from outside, wherein the suction-side fluid passage 4 and the discharge-side fluid passage 5 are expandable and contractible in the pipe axial direction.

According to the above configuration, the suction valve 321 and the discharge valve 331 can be opened from the outside. Thus, residue remaining in each of the pump sections 3 is allowed to flow into the suction-side fluid passage 4 or the discharge-side fluid passage 5 through the opened suction valve 321 or discharge valve 331. The suction-side fluid passage 4 and the discharge-side fluid passage 5 are expanded and contracted in the pipe axial direction so that when the suction-side fluid passage 4 and the discharge-side fluid passage 5 are shortened, separate maintenance can be performed by separating one or some of the plurality of pump sections 3 from the remaining pump section 3 or pump sections 3.

It can be configured such that the suction-side fluid passage or the discharge-side fluid passage includes between adjacent ones of the suction parts 32 or the discharge parts 33 of the plurality of pump sections 3: a first pipe 421, 521 that is located on one side in the pipe axial direction; a second pipe 422, 522 that is located on the other side in the pipe axial direction; and a stopper 423, 523 that is disposed over between the first pipe 421, 521 and the second pipe 422, 522 to fix the first pipe 421, 521 and the second pipe 422, 522 to each other immovably in the pipe axial direction; the first pipe 421, 521 and the second pipe 422, 522 are partially overlapped with each other in the pipe axial direction; in the overlapped portion, the second pipe 422, 522 has an outer diameter smaller than an inner diameter of the first pipe 421, 521 so that the first pipe 421, 521 and the second pipe 422, 522 are slidable relative to each other in the pipe axial direction; the stopper 423, 523 includes: a fixing piece 5231 that is located adjacent to an end of the first pipe 421, 521 in the pipe axial direction and on a radially outer side of the second pipe 422, 522; a sealing part 5232 that is held by the end of the first pipe 421, 521, an outer surface of the second pipe 422, 522, and the fixing piece 5231 to prevent leakage of fluid outside the pipes; and a fastening device C that is located on a radially outer side of the end of the first pipe 421, 521 and the fixing piece 5231 and configured to reduce a gap caused between the end of the first pipe 421, 521 and the fixing piece 5231.

According to the above configuration, the first pipe 421 and the second pipe 422 are partially overlapped with each other in the pipe axial direction so that the first pipe 421 and the second pipe 422 are slidable relative to each other in the pipe axial direction. The stopper 423, 523 includes the fixing piece 5231, the sealing part 5232, and the fastening device C. Therefore, a simplified configuration for expanding and contracting the suction-side fluid passage 4 and the discharge-side fluid passage 5 in the pipe axial direction can be achieved.

It can be configured such that a line 3L connecting the suction-valve operation member 322, the discharge-valve operation member 332, the suction valve 321, and the discharge valve 331 to each other crosses a line 4L, 5L along the pipe axial direction of the suction-side fluid passage 4 and the discharge-side fluid passage 5.

According to the above configuration, the line connecting the suction-valve operation member 322, the discharge-valve operation member 332, the suction valve 321, and the discharge valve 331 to each other crosses the line 4L, 5L along the pipe axial direction of the suction-side fluid passage 4 and the discharge-side fluid passage 5. Therefore, the operator can operate the operation member 322, 332 from the site away from the line 4L, 5L along the pipe axial direction of the suction-side fluid passage 4 and the discharge-side fluid passage 5. This contributes to good workability.

According to the above embodiment, it is possible to allow the residue remaining in each of the pump sections 3 to flow into the suction-side fluid passage 4 or the discharge-side fluid passage 5 through the opened suction valve 321 or discharge valve 331 by the operation of the operation member 322, 332. Thus, residue disposal can be easily made when the maintenance is performed. Further, maintenance can be performed only for one or some of the plurality of pump sections 3 by separating from the remaining pump section 3 or pump sections 3. Thus, it is easy to perform the maintenance only for one or some of the plurality of pump sections 3.

REFERENCE SIGNS LIST

1: Reciprocating pump (pump)
2: Main body
3: Pump section
4: Suction-side fluid passage
5: Discharge-side fluid passage
21: Motor
22: Pump shaft
31: Pump chamber
31S: Internal space of the pump chamber
32: Suction part

33: Discharge part
3L: Line connecting the operation member, the suction valve, and the discharge valve to each other
41: Fixed pipe (suction side)
42: Expansion pipe (suction side)
43: End pipe (suction side)
4L: Line along the pipe axial direction of the suction-side fluid passage
51: Fixed pipe (discharge side)
52: Expansion pipe (discharge side)
53: End pipe (discharge side)
5L: Line along the pipe axial direction of the discharge-side fluid passage
311: Diaphragm
321: Suction valve
322: Suction-valve operation member
331: Discharge valve
332: Discharge-valve operation member
421: First pipe (suction side)
422: Second pipe (suction side)
521: First pipe (discharge side)
522: Second pipe (discharge side)
423: Stopper (suction side)
523: Stopper (discharge side)
3111: Connection part (diaphragm)
3211: Valve body (suction side)
3212: Valve seat (suction side)
3213: Valve rod (suction side)
3214: Partition member (suction side)
3215: Seal member (suction side)
3221: Pin
3222: Cover
3311: Valve body (discharge side)
3312: Valve seat (discharge side)
3313: Valve rod (discharge side)
3314: Partition member (discharge side)
3315: Seal member (discharge side)
3321: Engaging member
3322: Through hole
3323: Bolt
5231: Fixing piece (discharge side)
5232: Sealing part (discharge side)
C: Fastening device
F: Ferrule

The invention claimed is:

1. A reciprocating pump comprising:

a plurality of pump sections that are disposed in parallel with each other, each of the plurality of pump sections including a suction part for inflow of fluid, and a discharge part for outflow of fluid;

a suction-side fluid passage for connection between the suction part of each of the plurality of pump sections; and a discharge-side fluid passage for connection between the discharge part of each of the plurality of pump sections;

each of the plurality of pump sections comprising:

a suction valve that allows and blocks circulation of fluid to be sucked, and a discharge valve that allows and blocks circulation of fluid to be discharged;

a suction-valve operation member comprising a pin that is covered by a first cover, the pin configured to be brought into an exposed state by detachment of the first cover, one end of the pin extends outside of the suction valve when the pin is in the exposed state, the pin configured to open the suction valve by pressing on the one end of the pin when the pin is in the exposed state; and a discharge-valve operation member comprising an engaging member that is covered by a second cover, the engaging member configured to allow a pull-up rod to be inserted into the discharge part by detachment of the second cover, the pull-up rod is configured to open the discharge valve by pulling on one end of the pull-up rod when the second cover is detached, wherein the suction-side fluid passage includes a suction-side fixed pipe that is fixedly provided to the suction part, and a suction-side expansion pipe that is connected to the suction-side fixed pipe and is expandable and contractible in a pipe axial direction, the discharge-side fluid passage includes a discharge-side fixed pipe that is fixedly provided to the discharge part, and a discharge-side expansion pipe that is connected to the discharge-side fixed pipe and is expandable and contractible in the pipe axial direction, the suction-side expansion pipe is shortened in the pipe axial direction to be separated from the suction part, and the discharge-side expansion pipe is shortened in the pipe axial direction to be separated from the discharge part.

2. The reciprocating pump according to claim 1, wherein the suction-side expansion pipe or the discharge-side expansion pipe comprises, between the respective suction part or the respective discharge part of adjacent pump sections of the plurality of pump sections: a first pipe that is located on one side of the suction-side fluid passage or the discharge-side fluid passage in the pipe axial direction; a second pipe that is located on an other side of the suction-side fluid passage or the discharge-side fluid passage in the pipe axial direction; and a stopper that is disposed over the first pipe and the second pipe to fix the first pipe and the second pipe to each other immovably in the pipe axial direction;

the first pipe and the second pipe are partially overlapped with each other in an overlapped portion in the pipe axial direction;

in the overlapped portion, the second pipe has an outer diameter smaller than an inner diameter of the first pipe so that the first pipe and the second pipe are slidable relative to each other in the pipe axial direction;

the stopper comprises: a fixing piece that is located adjacent to an end of the first pipe in the pipe axial direction and on a radially outer side of the second pipe; a sealing part that is held by the end of the first pipe, an outer surface of the second pipe, and the fixing piece to prevent leakage of fluid outside of the first and second pipes; and a fastening device that is located on a radially outer side of the end of the first pipe and the fixing piece and configured to reduce a gap caused between the end of the first pipe and the fixing piece.

3. The reciprocating pump according to claim 1, wherein a line connecting the suction-valve operation member, the discharge-valve operation member, the suction valve, and the discharge valve to each other crosses a line along the pipe axial direction.

4. The reciprocating pump according to claim 2, wherein a line connecting the suction-valve operation member, the discharge-valve operation member, the suction valve, and the discharge valve to each other crosses a line along the pipe axial direction.

* * * * *